US008160885B2

(12) United States Patent
Yang et al.

(10) Patent No.: US 8,160,885 B2
(45) Date of Patent: Apr. 17, 2012

(54) VOICE SIGNAL ENCODING/DECODING METHOD

(76) Inventors: Don Ming Yang, Hsin-Chu (TW); Sheng Yuan Huang, Hsin-Chu (TW)

( * ) Notice: Subject to any disclaimer, the term of this patent is extended or adjusted under 35 U.S.C. 154(b) by 710 days.

(21) Appl. No.: 11/456,737

(22) Filed: Jul. 11, 2006

(65) Prior Publication Data

US 2008/0015854 A1 Jan. 17, 2008

(51) Int. Cl.
*G10L 19/00* (2006.01)
*G10L 21/00* (2006.01)

(52) U.S. Cl. ..... 704/275; 704/230

(58) Field of Classification Search ..... 704/230, 704/254, 222, 226, 275; 395/2.16
See application file for complete search history.

(56) References Cited

U.S. PATENT DOCUMENTS 5,583,965 A * 12/1996 Douma et al. ..... 704/275
5,765,128 A * 6/1998 Tsuboi et al. ..... 704/222
6,611,803 B1 * 8/2003 Furuyama et al. ..... 704/254
6,816,837 B1 * 11/2004 Davis ..... 704/275
6,975,993 B1 * 12/2005 Keiller ..... 704/275

* cited by examiner

*Primary Examiner* — Talivaldis Ivars Smits
*Assistant Examiner* — Farzad Kazeminezhad
(74) *Attorney, Agent, or Firm* — Rosenberg, Klein & Lee

(57) ABSTRACT

The present invention is disclosed a voice signal encoding/decoding methods. It is judged whether the time-point at which the voices signal is about to be encoded is one of the synchronous time parameters in the steps of voice signal encoding. If yes, output an output port code to activate a task; otherwise, then output a voice signal coded value that corresponds to the encoded voice signal at the same time. Moreover, it is judged whether the time-point at which the voice signal coded value being about to be decoded corresponds to the voice signal is one of the synchronous time parameters. If yes, output the output port code to the output port to activate a task; if not, then output a voice subsignal that corresponds to the decoded voice signal coded value at the time-point.

3 Claims, 7 Drawing Sheets

VOICE SIGNAL ENCODING/DECODING METHOD

FIELD OF INVENTION

The present invention relates to a voice signal encoding/decoding method, and more particular to a voice signal encoding/decoding method that greatly simplifies the synchronization between the voice signal playing in voice signal processing means and the tasks.

BACKGROUND OF THE INVENTION

The voice signal integrated circuit (IC) is required to be synchronized with the executing state of the tasks while playing voice signal in many applications. And it mostly adopts a timer to synchronize the voice signal integrated circuit and the tasks in prior art. In such prior art systems a voice signal is decoded to be played by the voice signal integrated circuit from a start time to an end time. Take a specified application for example, it is required to initiate a first task when the voice signal is played to a first time $T_0$ and initiate a second task when the voice signal is played to a later time $T_1$. Wherein a timer is used for timing, and set at $T_0$ and $T_1$ to synchronize the voice signal playing with the first and second task by means of its timing function.

The designer of the specific application has to work out the correct count because of the timer used in the prior art mentioned above, that also will add difficulties to compile program codes and also will require inclusion of a timer in the hardware.

Regarding the above-mentioned shortage, the present invention provides a voice signal encoding/decoding method greatly simplifying the synchronization between the voice signal playing in voice signal processing means and the tasks.

SUMMARY OF THE INVENTION

The first object of the present invention is to provide a voice signal encoding/decoding method, which enables the voice signal in the process of decoding and playing, to be synchronized with the tasks.

The second object of the present invention is to provide a voice signal encoding/decoding method, which enables the voice signal processing circuit to be synchronized with the tasks.

The third object of the present invention is to provide a voice signal encoding/decoding method, which greatly simplifies the synchronization between the voice signal playing in voice signal processing methods and the tasks.

To achieve the objects mentioned above, the present invention provides a voice signal encoding/decoding method which comprises the following steps of: a voice signal encoding comprising: (A1). Setting at least one synchronous time parameter $P_0, P_1, P_2, \ldots, P_n$ (n>=1) during the period from the start time to the end time of a voice signal; (A2). Judging whether the time-point at which the voice signal is about to be encoded is one of the synchronous time parameters $P_0$, $P_1$, $P_2, \ldots, P_n$ (n>=1); (A3). Outputting an output port code if the result of the step of (A2) is true; outputting a voice signal coded value that corresponds to the voice signal processed by a voice signal encoding means at the time-point if the result of the step (A2) is false, and wherein the output port code is different from the voice signal coded value. (A4). Repeating the steps of (A2) and (A3) till the end time of the voice signal. And a voice signal decoding comprising: (B1). Judging whether the time-point at which the voice signal coded value being about to be decoded corresponds to the voice signal is one of the synchronous time parameters $P_0$, $P_1$, $P_2, \ldots, P_n$ (n>=1); (B2). Outputting an output port code to an output port if the result of the step (B1) is true; outputting a voice sub-signal which corresponds to the voice signal coded value processed by a voice signal decoding means at the time-point if the result of the step (B2) is false; (B3). Repeating the steps of (B1) and (B2) till all the voice signal coded values finish the voice signal decoding processing.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
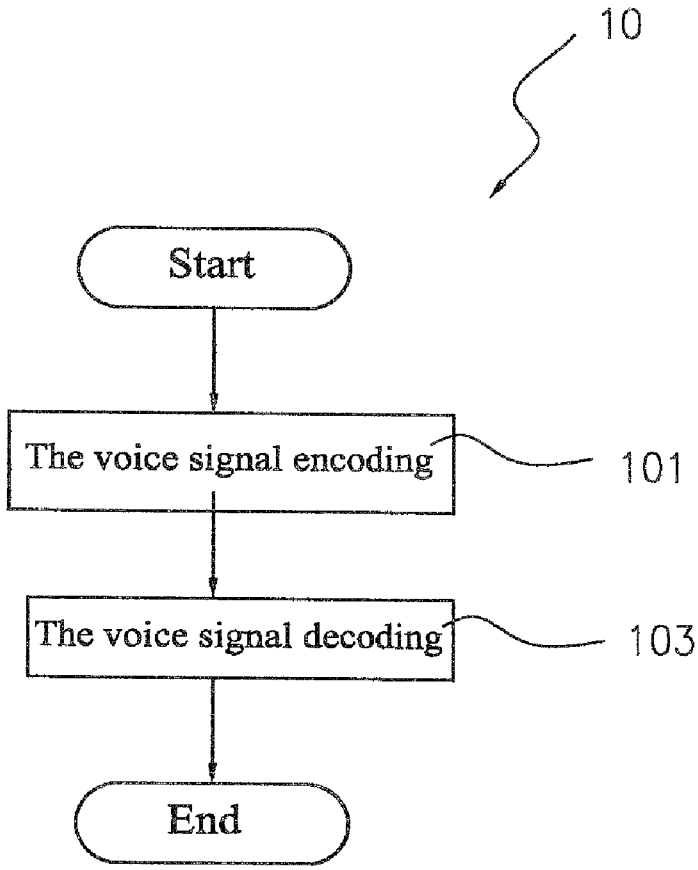
FIG. 1 is the flow chart of the voice signal encoding/decoding method of the present invention.

FIG. 1 is the flow chart of the voice encoding/decoding method of the present invention. The voice signal encoding/decoding method 10 provides a voice signal processing circuit (e.g. a voice signal integrated circuit) to perform the present invention, which can be synchronized with the executing states of the tasks while decoding and playing the voice signal, by means of outputting output port codes to output port. The voice signal encoding/decoding method of the present invention comprises the voice signal encoding 101 and the voice signal decoding 103, which are described respectively hereinbelow.

Figure 2:
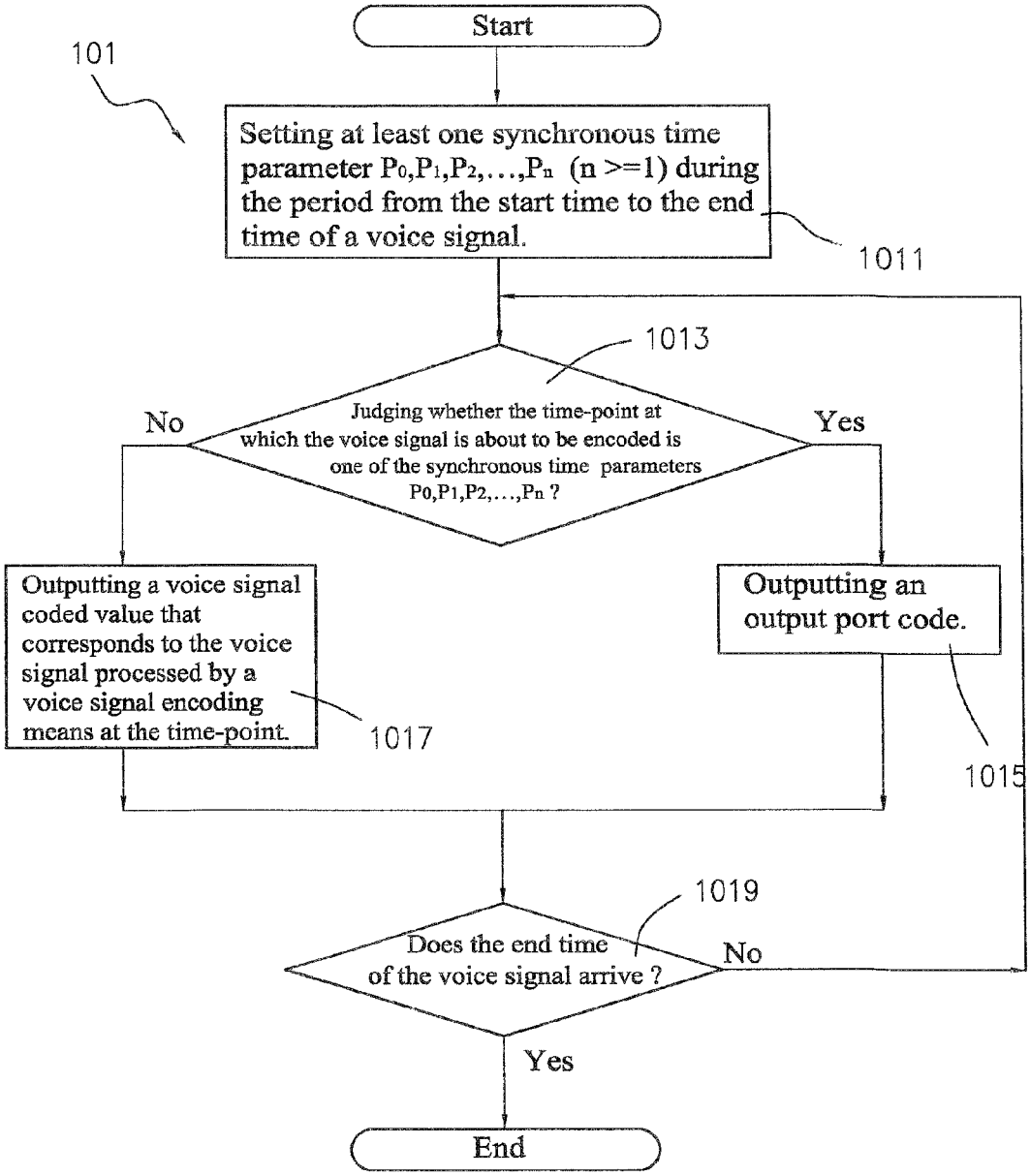
FIG. 2 is the flow chart illustrating the steps of voice signal encoding in the present invention.

FIG. 2 is the flow chart illustrating the steps of voice signal encoding 101 in the present invention, wherein the steps are described hereinbelow.

Figure 4:
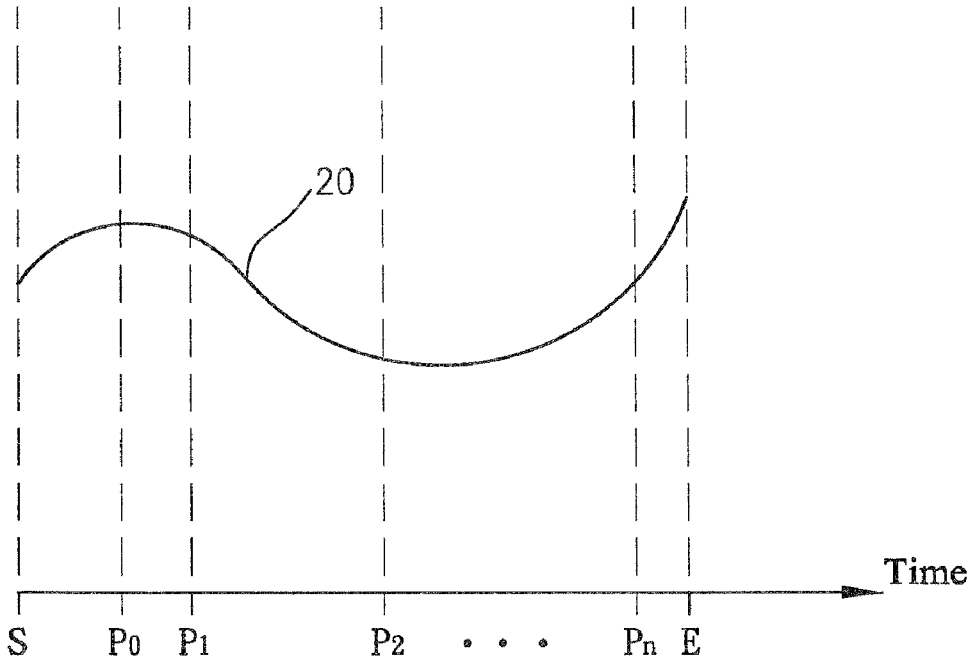
FIG. 4 is the schematic diagram illustrating the synchronization between the voice signal playing and the task adopting the methods of the present invention.

In the step 1011, at least one synchronous time parameter $P_0, P_1, P_2, \ldots, P_n$(n>=1) are set during the period from the start time S to the end time E of the voice signal 20. With reference to FIG. 4, the synchronous time parameters $P_0$, $P_1P_2, \ldots, P_n$are used for connecting the voice signal 20 and the executing states of the tasks. For example, to illustrate the relevance between the voice signal 20 and the executing states of the tasks, supposing that the voice signal 20 is a signal about how to operate digital camera, the display task to display the operating interface can be synchronized with the voice signal 20 at the time-point of the synchronous time parameter $P_0$ when the voice signal 20 is played to $P_0$. Then the display task generates a first operating interface and shows it on the display (unshown). The display task generates a second operating interface and shows it on the display when the continuously played voice signal 20 is played to the time-point of the synchronous time parameter $P_1$. It adopts the means mentioned above till the end time E of the voice signal 20 to carry on playing the voice signal 20 and executing the display task.

In the step 1013, it is judged whether the time-point at which the voice signal 20 is about to be encoded is one of the synchronous time parameters $P_0, P_1, P_2, \ldots, P_n (n>=1)$. If the result of the judgment in the step 1013 is true, then enter the step 1015; if not, then enter the step 1017. And an output port code is output in the step 1015. And a voice signal coded value, which corresponds to the voice signal 20 processed by a voice signal encoding means at the time-point, is output in the step 1017.

In the steps 1013, 1015, 1017, the time-points at which the voice signal 20 is encoded will reach the synchronous time parameter $P_0, P_1, P_2, \ldots, P_n (n>=1)$ one by one respectively, and an output port code is output at the same time. As illustrated in the example mentioned above, two output port codes are output respectively when it reaches $P_0$, $P_1$ respectively. Take notice of that the two output port codes instruct the display task to generate the first operating interface and the second operating interface and to show them on the display respectively when the time that the voice signal 20 is decoded reaches the synchronous time parameters $P_0$, $P_1$ respectively.

In the steps 1013, 1015, 1017, the corresponding voice signal coded values are output by the voice signal encoding means at the other time-points at which voice signal 20 is encoded.

The output port code mentioned above can be an index value, and it's different from the output voice signal coded values in the voice signal encoding 101, hereby it can be distinguished from the voice signal coded values. Take waveform coding for example, the encoder is a five-bit length encoder, which adopts the bit allocation from binary [00000] to binary [11111]. As for the embodiment of the voice signal encoding/decoding method 10 in the present invention, it adopts the bit allocation from binary [00000] to binary [11110] as the voice signal coded values and a binary [11111] as the output port code.

In the step 1019, it is judged whether the end time E of the voice signal 20 arrives. If not, then return to the step 1013; if yes, then end the step of voice signal encoding 101.

Figure 3:
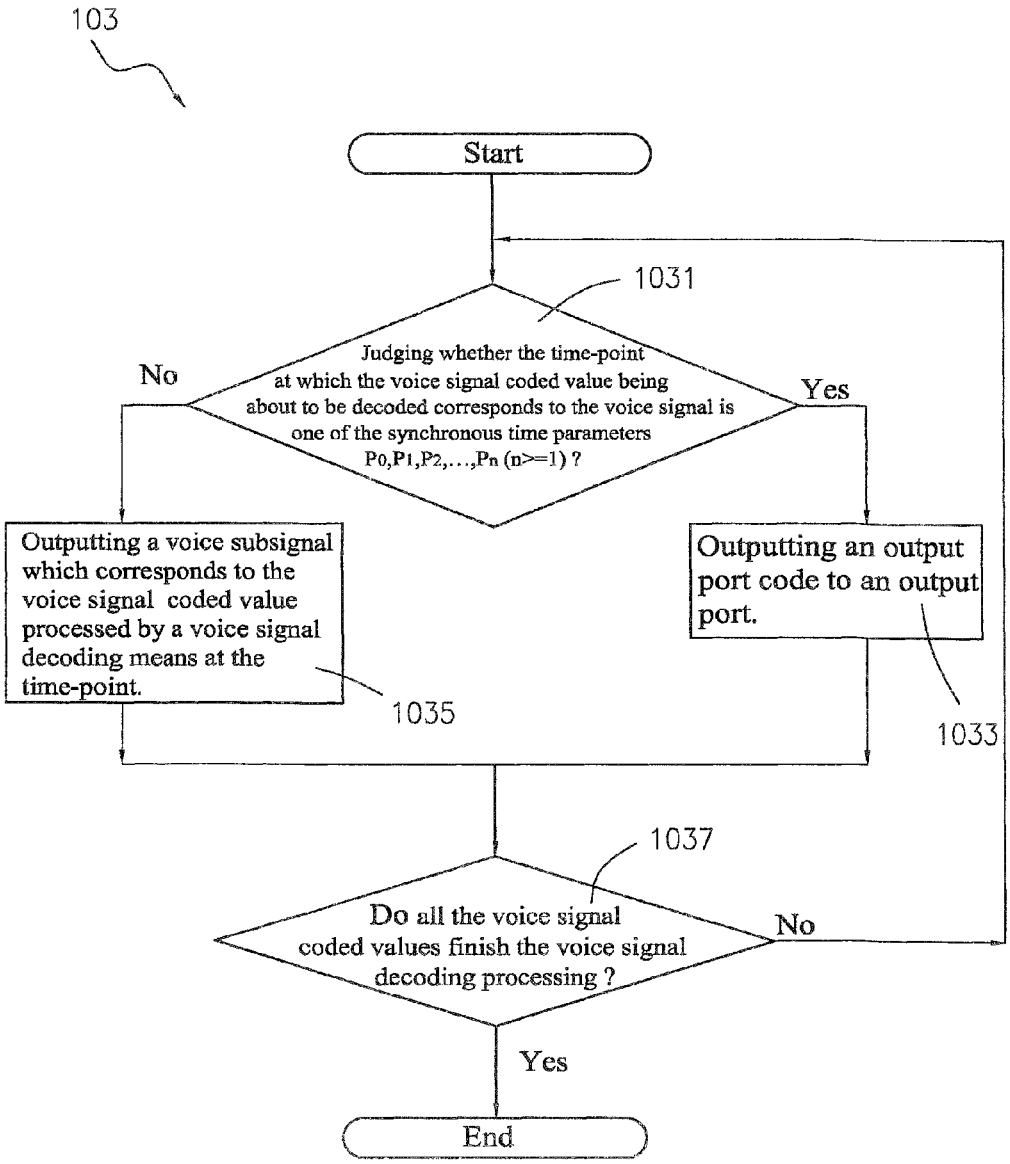
FIG. 3 is the flow chart illustrating the steps of voice signal decoding in the present invention.

FIG. 3 is the flow chart illustrating the steps of voice signal decoding 103 in the present invention, wherein the steps are described hereinbelow.

In the step 1031, it is judged whether the time-point at which the voice signal coded value being about to be decoded corresponds to the voice signal 20 is one of the synchronous time parameters $P_0, P_1, P_2, \ldots, P_n$ (n>=1). If yes, then enter step 1033; if not, then enter step 1035. And an output port code is output to an output port in the step 1033. A voice subsignal that corresponds to the voice signal coded value processed by a voice signal decoding means is output in step 1035.

In the steps 1031, 1033, 1035, it is judged whether the corresponding voice signal coded values at the time-point of the voice signal 20 are identical to the output port code. If yes, an output port code will be output to an output port. If not, a voice subsignal that corresponds to the voice signal coded value processed by the voice signal decoding means will be output.

The time-points at which voice signal 20 is decoded and synthesized will reach the synchronous time parameters $P_0$, $P_1, P_2, \ldots, P_n$ (n>=1) one by one, and an output port code will be output to an output port at the same time. As illustrated in the example mentioned above, two output port codes are output to the output port respectively when the time-points at which the voice signal 20 is decoded and synthesized reach the synchronous time parameters $P_0$, $P_1$ respectively. Take notice of that two output port codes instruct the display task to generate the first and the second operating interface and to show them on the display respectively.

In the steps 1031, 1033, 1035, the corresponding voice subsignals are output by the voice signal decoding means at the other time-points of decoded voice signal 20.

In the step 1037, it is judged whether all the voice signal coded values finish the voice signal decoding processing. If not, then return to the step 1031. If yes, then end the step of voice signal decoding 1031.

Figure 5:
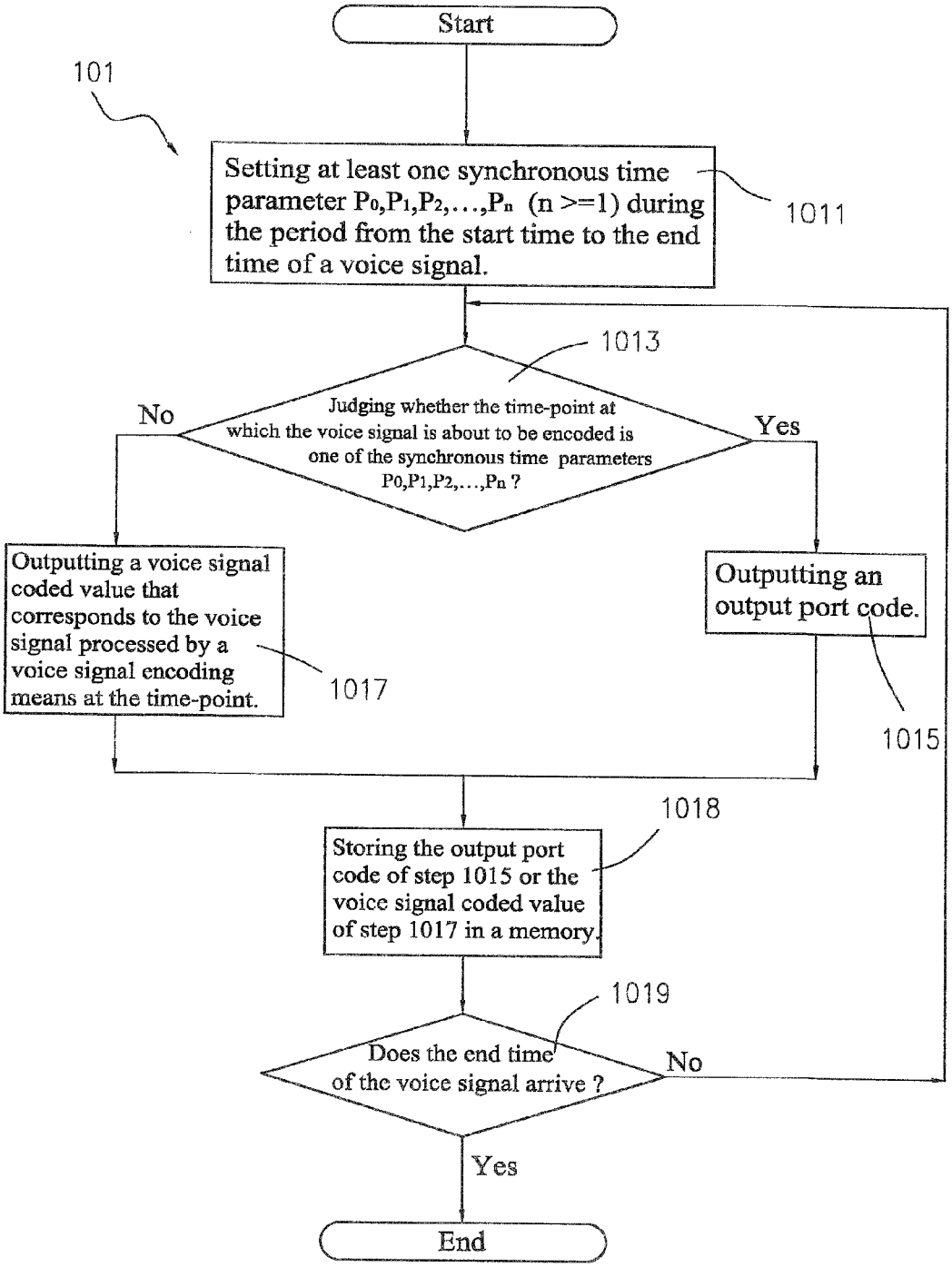
FIG. 5 is the flow chart of another embodiment illustrating the steps of voice signal encoding in the present invention.

Moreover it adopts a memory to store the voice signal coded values and the output port codes generated in the voice signal encoding 101. FIG. 5 is the flow chart of another embodiment illustrating the steps of voice signal encoding 101 in the present invention, wherein it stores the output port code output in the step 1015 and the voice signal coded value output in the step 1017 in the memory in the step 1018.

Figure 6:
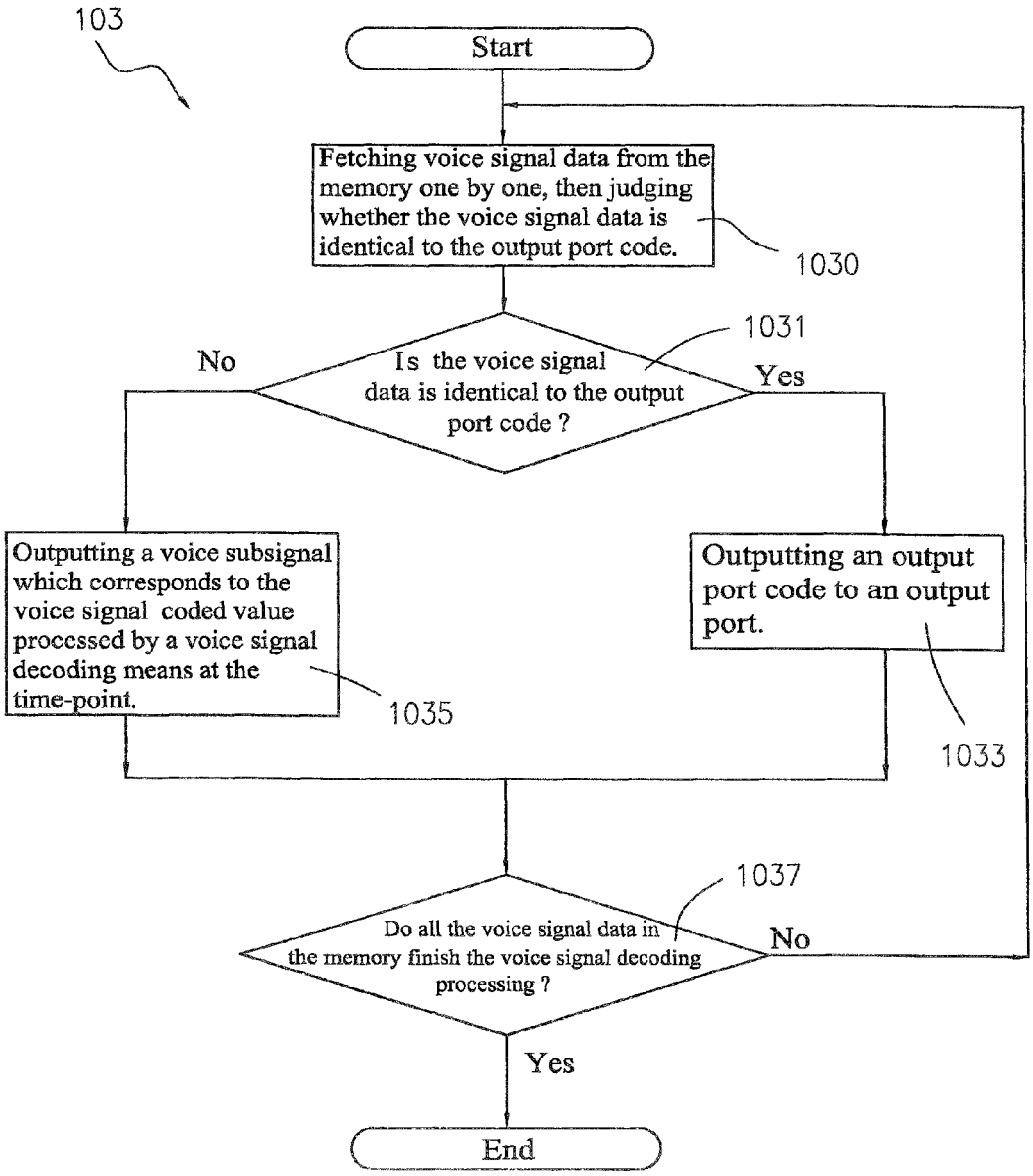
FIG. 6 is the flow chart of another embodiment illustrating the steps of voice signal decoding in the present invention.

FIG. 6 is the flow chart of another embodiment illustrating the steps of voice signal decoding 103 in the present invention. In the step 1030, the voice signal data is fetched from the memory one by one. In the step 1031, it is judged whether the voice signal data is identical to the output port code. If yes, then enter the step 1033; if not, then enter the step 1035. In the step 1033, an output port code is output to an output port. In the step 1035, the voice subsignal corresponding to the encoded voice signal data is output. In step 1037, it is judged whether all the voice signal data in the memory finishes the voice signal decoding processing. If yes, then end the step of voice signal decoding 103; if not, then return to the step 1030.

Figure 7:
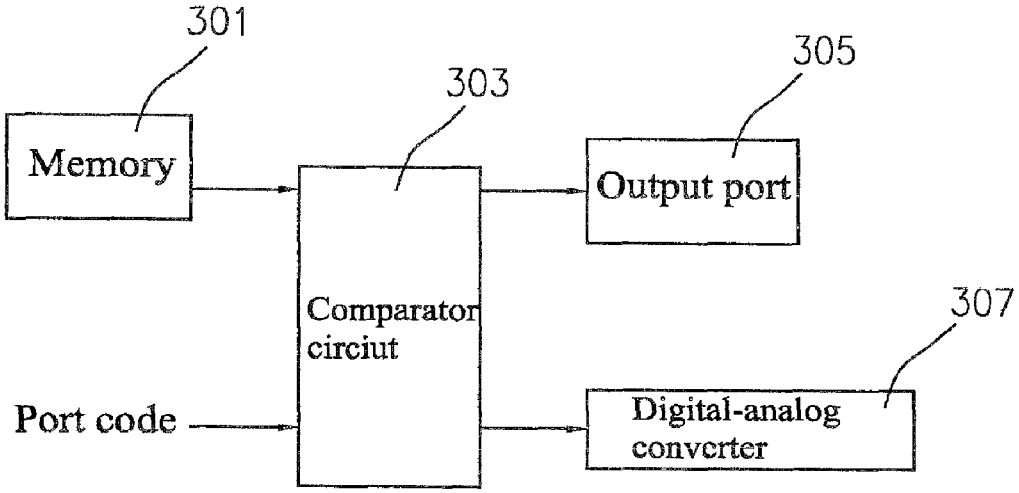
FIG. 7 is the circuit block diagram illustrating the voice signal processing circuit that performs the voice signal encoding/decoding method of the present invention.

FIG. 7 is the circuit block diagram illustrating the voice signal processing circuit that performs the voice signal encoding/decoding method of the present invention. It illustrates an embodiment that shows part of the voice signal processing circuit, wherein the memory 301 is used for storing plural voice signal data consisting of plural voice signal coded values and plural numbers identical to the output port code. The comparator circuit 303 is applied to receive the output port code and the voice signal data in the memory 301 and then to judge whether they are identical. If yes, then the comparator circuit 303 will output an output port code to the output port 305; If not, then the comparator circuit 303 will output the received voice signal data to the digital-analog converter 307, next the digital-analog converter 307 will convert the voice signal data to the corresponding voice subsignal.

The encoder means for voice signal encoding of the voice signal encoding/decoding method 10 in the present invention can adopt existing voice signal encoding arts, for example, waveform coding means, parameter coding means and hybrid coding means etc. The decoder means for voice signal decoding of the voice signal encoding/decoding method 10 in the present invention can adopt existing voice signal decoding arts, for example, the decoding means that corresponds to waveform coding means, the decoding means that corresponds to parameter coding means and the decoding means that corresponds to hybrid coding means etc.

The voice signal encoding/decoding method 10 would not cause distortion of sound quality in voice signal encoding/decoding, however it provides a solution of high efficiency that makes it easily to synchronize the voice signal playing and the tasks.

While the invention has been particularly shown and described with reference to the preferred embodiments thereof, these are, of course, merely examples to help clarify the invention and are not intended to limit the invention. It will be understood by those skilled in the art that various changes, modifications, and alterations in form and details may be made therein without departing from the spirit and scope of the invention, as set forth in the following claims.

What is claimed is:

1. A voice signal encoding/decoding method for synchronizing a voice signal to a voice signal processor, comprising following steps:

encoding the voice signal;

and decoding the voice signal;

wherein said step of encoding further comprises following steps:

(A1). setting at least one of a plurality of synchronous time parameters P0, P1, P2, . . . , Pn (n>=1) during a period between a start time and an end time of a voice signal, wherein said synchronous time parameters P0, P1, P2, . . . , Pn are used for connecting the voice signal and a plurality of tasks;

(A2). judging whether a time-point at which said voice signal is about to be encoded is one of said synchronous time parameters P0, PbP2, . . . , Pn;

(A3). outputting an output port code if the time-point in step A2 is one of said synchronous time parameters, said output port code being for activation of a task; and outputting a voice signal coded value corresponding to said voice signal processed by a voice signal encoding means at said time-point if said time-point is not one of said synchronous time parameters, storing said output port code and said voice signal coded value as a voice signal data in a memory, wherein said output port code is different from said voice signal coded value; and (A4). repeating steps A2 and A3 until an end time of said voice signal being reached;

said step of decoding further comprising following steps:

(B1). fetching said voice signal data from said memory;

(B2). judging whether the time-point at which the voice signal data corresponds to one of said synchronous time parameters P0, P1, P2, . . . , Pn (n>=1);

(B3). outputting said voice signal data as said output port code to an output port to activate a task, if said time-point is one of said synchronous time parameters; and outputting said voice signal data as said voice signal coded value to a voice signal decoding means to provide a voice subsignal corresponding to said time-point if said time-point is not one of said synchronous time parameters; and (B4). repeating steps of B 1, B2 and B3 until step B3 has been completed for a last voice signal data in said memory;

wherein said voice subsignal is asynchronous to said synchronous time parameters.

2. The voice signal encoding/decoding method for synchronizing the voice signal to a voice signal processor claimed in claim 1, wherein said voice signal encoding means is one of any voice signal encoding means.

3. The voice signal encoding/decoding method for synchronizing the voice signal to a voice signal processor claimed in claim 1, wherein said voice signal decoding means is one of any voice signal decoding means which corresponds to the voice signal encoding means.

* * * * *